US010569940B2

(12) United States Patent
Davies

(10) Patent No.: US 10,569,940 B2
(45) Date of Patent: Feb. 25, 2020

(54) CAP ASSEMBLIES WITH MAGNETIC CLOSURE RETENTION MECHANISMS AND DRINK CONTAINERS INCLUDING THE SAME

(71) Applicant: CamelBak Products, LLC, Petaluma, CA (US)

(72) Inventor: Jeff Davies, Windsor, CA (US)

(73) Assignee: CAMELBAK PRODUCTS, LLC, Petaluma, CA (US)

( * ) Notice: Subject to any disclaimer, the term of this patent is extended or adjusted under 35 U.S.C. 154(b) by 71 days.

(21) Appl. No.: 15/792,332

(22) Filed: Oct. 24, 2017

(65) Prior Publication Data

US 2018/0362225 A1 Dec. 20, 2018

Related U.S. Application Data

(60) Provisional application No. 62/520,001, filed on Jun. 15, 2017.

(51) Int. Cl.

| | |
|---|---|
| ***B65D 47/08*** | (2006.01) |
| ***B65D 51/24*** | (2006.01) |
| ***B65D 43/02*** | (2006.01) |
| ***B65D 1/02*** | (2006.01) |

(52) U.S. Cl.

CPC ..... *B65D 47/0876* (2013.01); *B65D 43/02* (2013.01); *B65D 51/242* (2013.01); *B65D 1/023* (2013.01)

(58) Field of Classification Search

CPC ..... A47G 19/2266; A47G 19/2272; A47G 19/2227; A47G 23/16; B65D 2543/00009;

(Continued)

(56) References Cited

U.S. PATENT DOCUMENTS

| | | | |
|---|---|---|---|
| 2,117,407 | A | 5/1938 | Davis |
| D133,978 | S | 10/1942 | Johnson |

(Continued)

FOREIGN PATENT DOCUMENTS

| | | | |
|---|---|---|---|
| CN | 203064388 | U | 7/2013 |
| CN | 103619723 | B | 3/2014 |

(Continued)

OTHER PUBLICATIONS

English-language machine translation of French Patent No. 2786465 A1, Global Patent Solutions, Jun. 29, 2016.

(Continued)

*Primary Examiner* — Robert J Hicks

(74) *Attorney, Agent, or Firm* — Amardeep S. Grewal; Gerard M. Donovan; Reed Smith LLP

(57) ABSTRACT

Cap assemblies with magnetic closure retention mechanisms and drink containers including the same. A cap assembly includes a base, a drink spout defining a passage, a closure configured to be selectively transitioned between a closed configuration and a stowed configuration via an open configuration, and a magnetic closure retention mechanism to magnetically retain the closure in the stowed configuration. When the closure is in the closed configuration, the closure is operatively coupled to the drink spout and obstructs the flow of liquid therethrough. When the closure is in the open configuration or the stowed configuration, the drink spout is uncovered and unobstructed by the closure. When the closure is in the stowed configuration, the closure is magnetically retained against the base or a handle of the cap assembly.

24 Claims, 6 Drawing Sheets

(58) Field of Classification Search
CPC ..... B65D 2543/00046; B65D 47/0876; B65D 43/02; B65D 51/242; B65D 1/023; B65D 83/04; B65D 83/06; B65D 50/00; B65D 39/00; B65D 2101/00; B65D 2251/00; B65D 81/26; B65D 85/00; B65D 2313/04; B65D 2251/10; B65D 51/24; B65D 51/18; B65D 47/0838; B65D 2251/1008; A61J 1/03; Y10T 16/44
USPC ..... 220/711, 375, 756, 752, 230, 703, 220/831–834, 212.5, 212, 259.1, 256.1, 220/254.7, 254.3, 254.1; 206/528, 534, 206/204, 459.1; 215/306, 228; 16/111.1
See application file for complete search history.

(56) References Cited

U.S. PATENT DOCUMENTS 2,549,225 A 4/1951 Moy
2,588,275 A 3/1952 Nadai
2,957,596 A 10/1960 Rehborg
2,962,185 A 11/1960 Starr et al.
3,181,725 A 5/1965 Friedl
3,307,752 A 3/1967 Anderson
3,944,104 A 3/1976 Watson et al.
4,265,363 A 5/1981 Conn
4,711,365 A 12/1987 Fomby
D319,981 S 9/1991 Sledge
5,044,512 A 9/1991 Giancaspro et al.
5,207,341 A 5/1993 Yeager
5,244,106 A 9/1993 Takacs
D368,032 S 3/1996 Couto
5,597,082 A 1/1997 Luch et al.
5,624,410 A * 4/1997 Tsukada ..... A61M 39/20 604/256
D399,744 S 10/1998 Gross
5,853,093 A * 12/1998 Neiger ..... B65D 41/0471 215/237
5,947,310 A 9/1999 Wagner
6,032,829 A 3/2000 Geisinger et al.
6,050,434 A * 4/2000 McNab ..... B65D 47/0809 215/235
6,079,589 A 6/2000 Matsuyama et al.
6,112,926 A 9/2000 Fishman
6,131,755 A 10/2000 Soyka, Jr. et al.
6,230,944 B1 5/2001 Castellano et al.
D457,779 S 5/2002 Gullickson et al.
6,382,450 B1 5/2002 De Rosa et al.
D471,808 S 3/2003 de Castro Couto
6,648,158 B1 11/2003 Lawrence
6,675,998 B2 1/2004 Forsman et al.
D489,613 S 5/2004 Campbell et al.
7,014,077 B2 3/2006 Brown
D547,607 S 7/2007 Forsman
7,344,646 B2 3/2008 Flick
D565,353 S 4/2008 Roth et al.
7,448,509 B2 11/2008 Yang
D586,184 S 2/2009 Miller et al.
D592,913 S 5/2009 Pinelli et al.
7,533,783 B2 5/2009 Choi et al.
7,611,025 B2 * 11/2009 Nusbaum ..... B65D 47/0838 215/235
D605,942 S 12/2009 Miksovsky
D612,731 S 3/2010 Bragg
D614,440 S 4/2010 Cresswell et al.
7,753,240 B2 7/2010 Leoncavallo et al.
D626,837 S 11/2010 Meyers et al.
D626,838 S 11/2010 Meyers et al.
7,866,183 B2 1/2011 Roth et al.
7,870,968 B2 1/2011 Hanson
D634,161 S 3/2011 Roth et al.
D636,671 S 4/2011 Lohman et al.
D640,093 S 6/2011 Picozza et al.
D641,623 S 7/2011 Fields
7,980,403 B2 7/2011 Martinez
D643,718 S 8/2011 Fields
8,051,997 B2 11/2011 Buckley
D649,879 S 12/2011 Gullickson et al.
D652,256 S 1/2012 Eyal
D654,793 S 2/2012 Rosbach
D657,618 S 4/2012 Wahl
D657,994 S 4/2012 Wahl et al.
8,191,727 B2 6/2012 Davies et al.
8,245,870 B2 8/2012 McKinney et al.
D669,310 S 10/2012 Barreto et al.
8,328,037 B2 12/2012 Wu
8,371,244 B2 2/2013 Krasner
D678,717 S 3/2013 Yasui
D679,541 S 4/2013 Samartgis
D682,034 S 5/2013 El-Saden et al.
8,443,993 B1 5/2013 Desselle
8,443,994 B1 5/2013 Desselle
D683,581 S 6/2013 Archer
8,469,226 B2 6/2013 Davies et al.
8,505,787 B2 8/2013 Fox et al.
8,522,997 B2 9/2013 Lane et al.
8,613,369 B2 12/2013 Kitto
8,622,229 B2 1/2014 Lane
8,752,720 B1 * 6/2014 Habig ..... B65D 55/16 215/306
D719,444 S 12/2014 Sullivan
D719,780 S 12/2014 Sullivan
8,905,252 B2 * 12/2014 Latham ..... B65D 51/18 215/228
9,284,174 B2 3/2016 Springer
D763,076 S 8/2016 Lane et al.
D786,619 S 5/2017 Joseph et al.
2004/0211778 A1 * 10/2004 Lien ..... B65D 33/06 220/212.5
2005/0011897 A1 1/2005 Stuart
2005/0274741 A1 12/2005 Cho
2007/0039959 A1 2/2007 Choi et al.
2007/0062963 A1 * 3/2007 Cooper ..... B65D 43/166 220/833
2008/0017642 A1 1/2008 King
2008/0087624 A1 4/2008 Buckley
2008/0142466 A1 6/2008 Balitski
2009/0134112 A1 5/2009 Reeves
2009/0152231 A1 6/2009 Hanson
2009/0236341 A1 9/2009 McKinney et al.
2009/0250426 A1 10/2009 Martinez
2010/0181329 A1 7/2010 Davies et al.
2011/0127232 A1 6/2011 Willows et al.
2011/0174993 A1 7/2011 Blain
2011/0284541 A1 11/2011 Webster et al.
2012/0067915 A1 * 3/2012 Lepage ..... B65D 43/24 220/831
2012/0145713 A1 6/2012 Jung
2012/0199548 A1 8/2012 Kitto
2012/0298614 A1 11/2012 Nelson
2014/0263324 A1 * 9/2014 Latham ..... B65D 51/18 220/259.1
2017/0043916 A1 2/2017 Seiders et al.
2017/0158412 A1 * 6/2017 Seiders ..... B65D 25/2835
2017/0354289 A1 * 12/2017 Marina ..... A47J 31/407

FOREIGN PATENT DOCUMENTS

EP 2673212 A2 12/2013
FR 2786465 A1 6/2000
KR 20100008131 A 1/2010
KR 20140082590 A 7/2014
WO WO 2012/095491 A1 7/2012
WO WO 2017/031061 A1 2/2017

OTHER PUBLICATIONS

English-language machine translation of Korean Patent Publication No. 20100008131 A, Global Patent Solutions, Jun. 29, 2016.
English-language machine translation of Chinese Patent No. 203064388 U, Global Patent Solutions, Jun. 29, 2016.

(56) References Cited

OTHER PUBLICATIONS

English-language machine translation of Chinese Patent No. 103619723 B, Global Patent Solutions, Jun. 29, 2016.
English-language machine translation of Korean Patent Publication No. 20140082590 A, Global Patent Solutions, Jun. 29, 2016.
Cool Gear 28oz Subzero Water Bottle, http://shop.coolgearinc.com/28oz-subzero/, retrieved Jun. 30, 2016, 4 pages.
Crestline. "Halo Water Bottle". Wayback Machine, http://www.crestline.com/halot-water-bottle-9452.aspx, Jan. 16, 2011, p. 1.
Diy Water Bottle Hack, https://everydaycarrysupply/com/blogs/hacksandtips/81155590-diy-water-bottle-hack, retrieved Jun. 30, 2016, 9 pages.
Liquid Hardware's Sidewinder Vacuum-Insulated, Magnetic Bottle, http://www.liquidhardware.com/insulated-aqua-silver-sidewinder-vacuum-bottle-20-oz-592-ml-powder-coated-in-usa/ retrieved Jun. 23, 2016, 3 pages.

* cited by examiner

CAP ASSEMBLIES WITH MAGNETIC CLOSURE RETENTION MECHANISMS AND DRINK CONTAINERS INCLUDING THE SAME

RELATED APPLICATION

This application claims priority under 35 U.S.C. § 119(e) to U.S. Provisional Patent Application No. 62/520,001, which is entitled "DRINK CONTAINERS WITH MAGNETIC CLOSURE RETENTION MECHANISMS," was filed on Jun. 15, 2017, and the disclosure of which is hereby incorporated by reference.

FIELD

The present disclosure relates to cap assemblies for drink containers, and more particularly to cap assemblies for portable drink containers with magnetic closure retention mechanisms and drink containers including the same.

BACKGROUND

Many individuals carry drink containers that hold water or other hot or cold potable beverages. These drink containers typically include a bottle that is formed from plastic or metal. These containers also frequently include a cap, which is removably secured to a neck or other opening of the bottle. As an example, some such drink containers include a threaded cap that is tethered to the neck of the container. Some conventional drink containers further include a drink spout, or nozzle, that is integral with the cap and from which liquid may be drawn from the drink bottle without removal of the cap from the bottle. Some such nozzles include a manual or automatic valve for selectively restricting liquid from being dispensed through the nozzle, and some do not. Examples of such drink containers with valved nozzles include squeezable drink containers with push-pull drink spouts and CAMELBAK® brand drink containers with bite-actuated mouthpieces. Some bottles further include a closure for sealing the drink spout. Some closures are untethered and/or are used with caps that do not include a retention mechanism for stowing the closure when it is not being used to close the nozzle. Some closures are tethered to the bottle so that upon removal of the closure from the drink spout, the closure does not become lost, misplaced, or otherwise separated from the bottle and/or cap. However, a closure that is coupled to a cap by a tether may otherwise be free to move relative to the cap (within a range of motion defined by the tether), and thus may be awkward or bothersome to a user attempting to drink from the drink spout. Thus, there exists a need for drink containers with improved closure retention mechanisms.

SUMMARY

Cap assemblies with magnetic closure retention mechanisms and drink containers including the same are disclosed herein. A cap assembly configured to be selectively coupled to a neck of a liquid container includes a base configured to be selectively coupled to the neck of the liquid container, a drink spout extending from the base and defining a passage for dispensing the potable drink liquid, and a closure configured to be selectively transitioned between a closed configuration and a stowed configuration via an open configuration. When the closure is in the closed configuration, the closure is operatively coupled to the drink spout to restrict a potable drink liquid from flowing through the passage. When the closure is in the open configuration, the drink spout is unobstructed by the closure, and the closure is spaced apart from the drink spout to permit a potable drink liquid to flow through the passage. When the closure is in the stowed configuration, the drink spout is unobstructed by the closure, and the closure is magnetically retained against a portion of the cap assembly. The cap assembly further includes a magnetic closure retention mechanism to magnetically retain the closure in the stowed configuration. The drink container includes a liquid container having a neck with an opening and having an internal compartment configured to hold a volume of potable drink liquid.

DETAILED DESCRIPTION

FIGS. 1-8 provide examples of drink containers 10 and/or cap assemblies 100 according to the present disclosure. Elements that serve a similar, or at least substantially similar, purpose are labeled with like numbers in each of FIGS. 1-8, and these elements may not be discussed in detail herein with reference to each of FIGS. 1-8. Similarly, all elements may not be labeled in each of FIGS. 1-8, but reference numbers associated therewith may be utilized herein for consistency. Elements, components, and/or features that are discussed herein with reference to one or more of FIGS. 1-8 may be included in and/or utilized with the subject matter of any of FIGS. 1-8 without departing from the scope of the present disclosure.

In general, elements that are likely to be included in a given (i.e., a particular) embodiment are illustrated in solid lines, while elements that are optional to a given embodiment are illustrated in dash-dot lines. However, elements that are shown in solid lines are not essential to all embodiments, and an element shown in solid lines may be omitted from a given embodiment without departing from the scope of the present disclosure.

Figure 1:
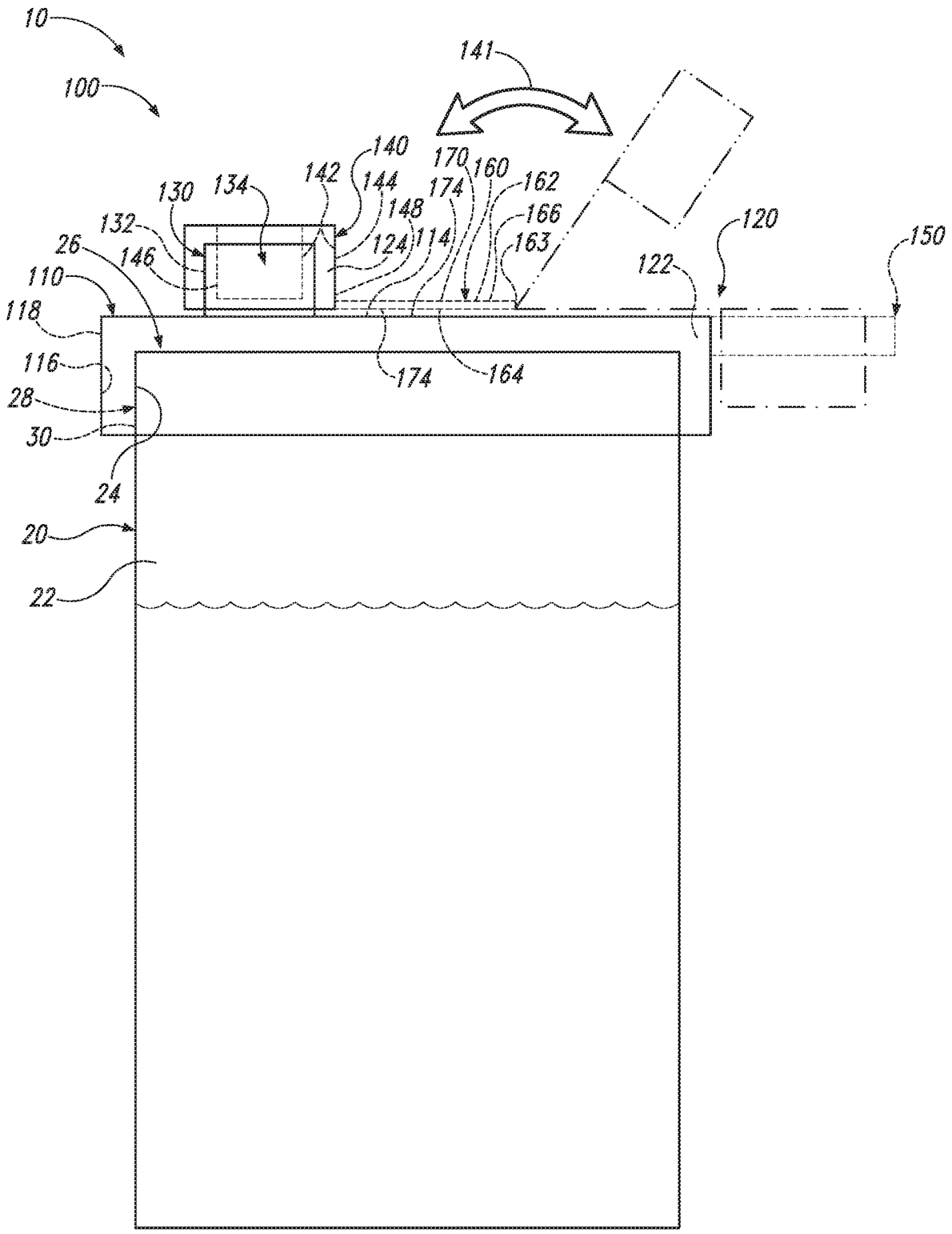
FIG. 1 is a schematic side elevation view representing examples of drink containers including cap assemblies according to the present disclosure.

As schematically illustrated in FIG. 1, a drink container 10 includes a liquid container 20 and a cap assembly 100. Liquid container 20 includes a neck 24 with an opening 26 and an internal compartment 22 configured to hold a volume of a potable drink liquid. Non-exclusive examples of potable drink liquids that may be used in drink containers 10 according to the present disclosure include such potable liquids as water, juice, sports drinks, soft drinks, coffee, tea, and the like. Cap assembly 100 is configured to be selectively coupled to neck 24 of liquid container 20. More specifically, cap assembly 100 includes a base 110 configured to be selectively coupled to neck 24 of liquid container 20, a drink spout 130 extending from the base and defining a passage 134 for dispensing the potable drink liquid, and a closure 140 configured to selectively restrict liquid from flowing through the passage. Base 110 may include a liquid container coupling structure 116 to selectively couple cap assembly 100 to liquid container 20.

Liquid containers 20 according to the present disclosure are adapted to receive and hold or otherwise contain up to a predetermined volume of potable drink liquid for selective consumption by a user, such as when the liquid is dispensed through drink spout 130 of cap assembly 100. Potable drink liquid may be selectively poured, or otherwise dispensed, into internal compartment 22 of the liquid container via neck 24. Potable drink liquid may be selectively dispensed from internal compartment 22 to a user from neck 24 when cap assembly 100 is not secured to the neck and/or when drink spout 130 is not sealed or otherwise obstructed by closure 140. It is within the scope of the present disclosure that neck 24 may (but is not required in all embodiments to) define the only opening through which potable drink liquid may be added to or removed from the liquid container. As discussed in more detail herein, when cap assembly 100 is operatively coupled to liquid container 20, this selective dispensing of the drink liquid may be only through drink spout 130 of the cap assembly when closure 140 is selectively removed from the drink spout.

Liquid containers 20 may have any suitable shape and may be formed from any suitable material or combination of materials to hold up to a predetermined volume of drink liquid. Illustrative, non-exclusive examples of suitable sizes, or capacities, of liquid containers 20 (i.e., volume of potable drink liquid able to be received into a liquid container at one time) include 4 ounces (oz.), 6 oz., 8 oz., 10 oz., 12 oz., 16 oz., 20 oz., 24 oz., 32 oz., 36 oz., 4-11 oz., 6-15 oz., 10-19 oz., 12-25 oz., 12-36 oz., 15-30 oz., 25-36 oz., 30-45 oz., 35-50 oz., and 10-70 oz. (with these examples referring to liquid (fluid) ounces of drink liquid that may be received at one time into an empty liquid container). It is within the scope of the present disclosure that liquid containers having different sizes, including sizes that are smaller than, larger than, or within the illustrative sizes and/or ranges presented above, may be used without departing from the scope of the present disclosure.

An example of a material that may be used to construct liquid containers 20 according to the present disclosure includes the TRITAN™ copolyester polymer developed by Eastman Chemical Company. Other examples of materials that may be suitable for construction of liquid containers, or portions thereof, according to the present disclosure include polycarbonate, glass, plastic, and/or metal, such as aluminum or stainless steel. Further examples are disclosed in U.S. Pat. Nos. 7,533,783 and 8,905,252, the complete disclosures of which are hereby incorporated by reference.

Liquid containers 20 may be (but are not required to be) rigid or at least semi-rigid and may include a bottom surface such that the liquid container may be generally self-supporting, or free-standing, when placed on a horizontal surface. In such embodiments, drink containers 10 may be referred to as drink bottles. Liquid containers 20 also optionally may have a double-wall or other insulated construction. In some embodiments, a liquid container 20 according to the present disclosure may be constructed of polyethylene or other material that permits the liquid container to have a semi-rigid construction in which the liquid container may be reversibly collapsed during use. Such an example may permit opposing portions of the liquid container to be squeezed and/or otherwise urged toward, or even into contact with, each other to reduce the volume of the liquid container and thereby aid in the dispensing of potable drink liquid therefrom. In such an embodiment, the liquid container may be configured to return automatically to its prior configuration upon reduction of the force and/or pressure that was applied to urge the sides of the liquid container toward each other. Such embodiments may be described as squeeze bottles, as having a squeezable liquid container, and/or as having a resiliently deformable liquid container.

Cap assemblies 100 according to the present disclosure may be adapted to be removably coupled to a liquid container 20 to cover, or otherwise enclose, the neck 24 thereof. When so coupled to liquid container 20, cap assembly 100 restricts drink liquid within internal compartment 22 of liquid container 20 from being dispensed from drink container 10 other than through drink spout 130. When drink spout 130 is obstructed or otherwise closed or sealed by closure 140, cap assembly 100 restricts potable drink liquid from being dispensed from liquid container 20. Accordingly, any potable drink liquid in internal compartment 22 of liquid container 20 is restricted from being dispensed to a user or otherwise removed from the liquid container until either cap assembly 100 is uncoupled from the liquid container or until closure 140 is removed from drink spout 130.

Although not required in all embodiments, cap assembly 100 typically is removably coupled to liquid container 20, such as to neck 24 thereof, to permit selective and non-destructive removal and replacement (i.e., repeated uncoupling and recoupling) of the cap assembly relative to the liquid container. For example, cap assembly 100 may be uncoupled from liquid container 20 to permit the liquid container to receive a volume of potable drink liquid, after which the cap assembly may be recoupled to the liquid container. Accordingly, drink containers 10 according to the present disclosure may include a coupling assembly 28, with liquid container 20 including a cap coupling structure 30, and with cap assembly 100 including liquid container coupling structure 116, which is adapted to selectively mate with cap coupling structure 30. In such an embodiment, neck 24 of liquid container 20 may include cap coupling structure 30, and base 110 of cap assembly 100 may include liquid container coupling structure 116. Coupling assembly 28 may provide a liquid-tight connection between cap assembly 100 and liquid container 20. When such a connection is established between cap assembly 100 and liquid container 20, the cap assembly may restrict liquid from being dispensed from the drink container other than through drink spout 130. Examples of coupling assembly 28 that may be incorporated into drink containers 10 according to the present disclosure include (but are not limited to) threads, snap-fit arrangements, friction-fit arrangements, clasp arrangements, etc.

Passage 134 of drink spout 130 may have any suitable passage length, such as lengths that are, or are similar to, the thickness of the material forming the upper surface of cap assembly 100, as well as lengths that are 2, 3, 4, 5, 10, or more times this thickness. Additional examples of suitable lengths include lengths of at least 1 millimeter (mm), at least 2 mm, at least 3 mm, at least 4 mm, at least 5 mm, at least 10 mm, at least 15 mm, at least 20 mm, at least 25 mm, at least 30 mm, at least 40 mm, at least 1-10 mm, at least 5-30 mm, at least 10-50 mm, less than 50 mm, less than 40 mm, less than 30 mm, less than 20 mm, less than 15 mm, less than 10 mm, and/or less than 5 mm. Passage 134 may have any suitable size that is suitable for dispensing potable drink liquid from drink container 10 to a user's mouth. As examples, passage 134 may have a cross-sectional area (measured transverse to the long axis of the passage) that is at least 50 square millimeters ($mm^2$), at least 75 $mm^2$, at least 100 $mm^2$, at least 200 $mm^2$, at least 300 $mm^2$, at least 400 $mm^2$, at least 500 $mm^2$, at least 600 $mm^2$, at least 50-300 $mm^2$, at least 100-500 $mm^2$, at least 250-750 $mm^2$, less than 750 $mm^2$, less than 600 $mm^2$, less than 500 $mm^2$, less than 400 $mm^2$, less than 300 $mm^2$, and/or less than 200 $mm^2$.

Drink spout 130 may be defined by a structure that is separate from base 110. Alternatively, base 110 and drink spout 130 may be defined by a unitary structure having a base portion and a drink spout portion. In some embodiments, drink spout 130 may extend from base 110 of cap assembly 100 and may define a structure that is configured to be received by a user's mouth. Drink spout 130 may be cylindrical, generally cylindrical, circular, elliptical, or may have any other suitable shape and/or cross-section, such as ergonomic shapes that facilitate comfortable engagement with a user's mouth for drinking potable drink liquid from drink container 10. As used herein, the term "unitary," as used to describe a structure that includes a plurality of portions and/or components, is intended to refer to a structure in which the plurality of portions and/or components are integrally formed, co-molded, fixedly connected, and/or otherwise configured not to be disconnected.

Closure 140 is configured to be selectively transitioned between a closed configuration, an open configuration, and a stowed configuration. When closure 140 is in the closed configuration (as illustrated in solid lines in FIG. 1), the closure is operatively coupled to drink spout 130 to restrict flow of the potable drink liquid through passage 134. When closure 140 is in the open configuration (an example of which is illustrated in dash-dot-dot lines in FIG. 1), drink spout 130 is unobstructed by the closure and the closure is spaced apart from the drink spout to permit flow of the potable drink liquid through passage 134. In the open configuration, the closure does not obstruct the drink spout's passage, and the closure may or may not be engaged with base 110 or a handle 150 of the cap assembly. When closure 140 is in the stowed configuration (as illustrated in dash-dot lines in FIGS. 1 and 2), drink spout 130 is unobstructed by the closure, the closure is spaced apart from the drink spout to permit flow of the potable drink liquid through passage 134, and the closure is magnetically retained against a portion of the cap assembly, such as base 110 or handle 150. Such a stowed configuration may be useful to prevent closure 140 from being lost, misplaced, or otherwise separated from liquid container 20 while a user is consuming potable drink liquid therefrom through drink spout 130. Additionally or alternatively, such a configuration may be useful to position closure 140 away from a user's nose, forehead, etc. when the user drinks directly from drink spout 130. Cap assembly 100 further includes a magnetic closure retention mechanism 120 to magnetically retain closure 140 in the stowed configuration. More specifically, when closure 140 is in the stowed configuration, the closure is magnetically retained against base 110 by magnetic closure mechanism 120.

Closure 140 is configured to be selectively transitioned between the closed configuration and the stowed configuration via the open configuration. Stated differently, closure 140 is configured to be selectively transitioned between the closed configuration and the open configuration and to be selectively transitioned between the open configuration and the stowed configuration. Hence, the open configuration may be described as an intermediate configuration between the closed configuration and the stowed configuration.

Figure 2:
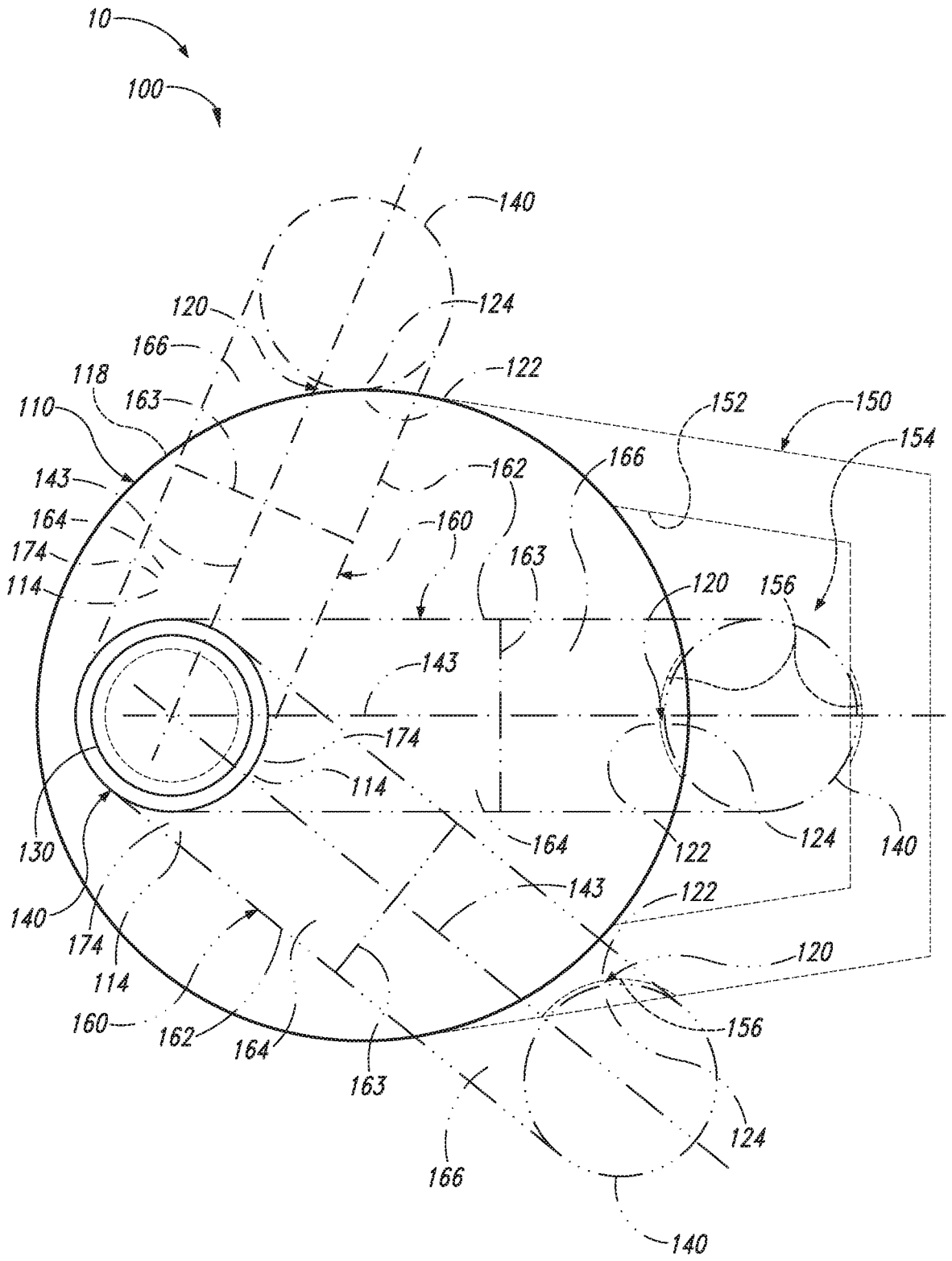
FIG. 2 is a schematic top plan view representing examples of cap assemblies according to the present disclosure.

As schematically illustrated in FIGS. 1-2, cap assembly 100 further may include a tether 160 that operatively couples closure 140 and base 110. Tether 160 may be configured to constrain closure 140 to travel along a predefined closure path 141 (schematically illustrated in FIG. 1) as the closure transitions between the closed configuration, the open configuration, and the stowed configuration. Stated differently, one or more of the closed configuration, the open configuration, and the stowed configuration may be at least partially defined by and/or determined by tether 160. More specifically, tether 160 may constrain motion of closure 140 relative to base 110 such that closure path 141 extends at least substantially within a predefined closure plane 143 (schematically illustrated in FIG. 2). Stated differently, tether 160 may constrain motion of closure 140 such that the closure at least substantially remains in closure plane 143, which is predefined and/or fixed with respect to base 110, as the closure transitions between the closed configuration, the open configuration, and the stowed configuration.

As schematically illustrated in FIGS. 1-2, magnetic closure retention mechanism 120 may include a base magnetic material 122 and a closure magnetic material 124 that produce an attractive magnetic force therebetween. Specifically, base 110 may include base magnetic material 122, and closure 140 may include closure magnetic material 124, such that an attractive magnetic force is produced between the base magnetic material and the closure magnetic material. Base magnetic material 122 and closure magnetic material 124 may include and/or be any appropriate materials for producing an attractive magnetic force to retain closure 140 in the stowed configuration. For example, one of base magnetic material 122 and closure magnetic material 124 may include and/or be a permanent magnet, and the other of the base magnetic material and the closure magnetic material may include and/or be a permanent magnet and/or a ferromagnetic material. Examples of permanent magnets include discrete magnets, sheet magnets, and/or bar magnets. Examples of ferromagnetic materials include materials that include iron, nickel, cobalt, and alloys thereof.

As further schematically illustrated in FIGS. 1-2, base 110 of cap assembly 100 may include a handle 150 configured to be gripped by a user, such as to carry drink container 10. In such an embodiment, base 110 may be described as including a base body portion 118, which is configured to be coupled to liquid container 20, and handle 150, which is configured to be gripped by a user, such that the handle extends from the base body portion. In such an embodiment, at least one of base body portion 118 and handle 150 may include base magnetic material 122. Handle 150 may be defined by a structure that is distinct from base body portion 118. Alternatively, base body portion 118 and handle 150 may describe respective regions of a unitary base 110. Stated differently, handle 150 and base body portion 118 may be integrally formed. Handle 150 may be fixed to base body portion 118, and/or otherwise not configured to move relative to the base body portion. For example, handle 150 may extend from base body portion 118 in a fixed orientation relative to the base body portion.

As illustrated in FIG. 2, handle 150 may form at least a portion of a closed perimeter 152 that defines a handle aperture 154 sized to receive at least one of a user's fingers.

Closed perimeter 152 also may be configured to receive a lanyard, carabiner, belt, strap, or other structure that may extend to hold and/or retain drink container 20 in a selected position and/or orientation.

As schematically illustrated in FIG. 2, closure 140 may be retained against any appropriate portion of base 110, base body portion 118, and/or handle 150 when the closure is in the stowed configuration. For example, and as illustrated in dash-dot lines in FIG. 2, closure 140 may at least partially abut and/or be at least partially positioned adjacent to base body portion 118 when the closure is in the stowed configuration. Additionally or alternatively, and as illustrated in dash-dot-dot lines in FIG. 2, closure 140 may be positioned at least substantially within handle 150, such as within closed perimeter 152, and/or may obstruct handle aperture 154, when the closure is in the stowed configuration. In such an embodiment, closure 140 also may be at least partially positioned adjacent to base body portion 118 when the closure is in the stowed configuration. Alternatively, and as illustrated in dash-dot-dot-dot lines in FIG. 2, closure 140 may at least partially abut and/or be at least partially positioned adjacent to handle 150 and/or closed perimeter 152 when the closure is in the stowed configuration. Additionally or alternatively, closure 140 may be positioned external to the closed perimeter when the closure is in the stowed configuration. For example, base magnetic material 122 may be at least partially positioned within handle 150, and closure 140 may be at least partially retained against the handle when the closure is in the stowed configuration. In such a configuration, closure 140 may be restricted from obstructing handle aperture 154 when the closure is in the closed configuration and when the closure is in the stowed configuration. As further schematically illustrated in FIG. 2, base 110 may include at least one closure recess 156 defined in the base such that closure 140 is received at least partially within at least one closure recess when the closure is in the stowed configuration. For example, base magnetic material 122 may be positioned within and/or proximal to closure recess 156 to magnetically retain closure 140 in the stowed configuration. Closure recess 156 may be at least partially defined by handle 150, such as an exterior portion of closed perimeter 152, and/or may be at least partially defined by base body portion 118, such as a region of the base body portion proximal to the handle.

As schematically illustrated in FIGS. 1-2, tether 160 may include a hinge 162 with at least one hinge pivot axis 163. Hinge 162 may include a first hinge component 164 and a second hinge component 166 such that the first hinge component is proximal drink spout 130 relative to closure 140 when the closure is in the stowed configuration, and such that the second hinge component is proximal the closure relative to the drink spout when the closure is in the stowed configuration. First hinge component 164 and second hinge component 166 each may be coupled to hinge pivot axis 163, and/or may be separated by the hinge pivot axis.

Hinge 162 may be configured such that first hinge component 164 and second hinge component 166 extend adjacent to one another and at least substantially parallel to one another when closure 140 is in the stowed configuration. Stated differently, and as schematically illustrated in FIG. 2, first hinge component 164 and second hinge component 166 may be at least substantially coplanar when closure 140 is in the stowed configuration. Additionally or alternatively, and as schematically illustrated in FIG. 1, first hinge component 164 may extend adjacent to and at least substantially parallel to an exterior surface of base 110 and/or of base body portion 118 at least when closure 140 is in the closed configuration and when the closure is in the stowed configuration.

Tether 160 and/or hinge 162 may have any appropriate construction and/or configuration such that the tether constrains closure 140 to travel along closure path 141 and/or within closure plane 143. For example, tether 160 may be at least substantially restricted from moving relative to base 110 when closure 140 is in the closed configuration and/or in the stowed configuration. As a more specific example, and as schematically illustrated in FIG. 2, a portion of tether 160 may extend around drink spout 130, and the portion of the tether that extends around the drink spout may be restricted from rotating relative to the drink spout. For example, base 110 may include at least one tether retainer 114 configured to restrict tether 160 from rotating relative to drink spout 130. As more specific examples, tether retainer 114 may include a recess that receives at least a portion of tether 160, and/or may include at least one projection that engages a corresponding retainer indentation 174 defined by tether 160. Additionally or alternatively, first hinge component 164 and second hinge component 166 may be at least substantially rigid, such as to restrict tether 160 from twisting in a manner that corresponds to closure 140 departing from closure plane 143. Additionally or alternatively, tether 160 and/or hinge 162 may be formed of unitary construction, and/or may be formed of a single material. In such a configuration, hinge 162 also may be referred to as a living hinge 162.

Figure 3:
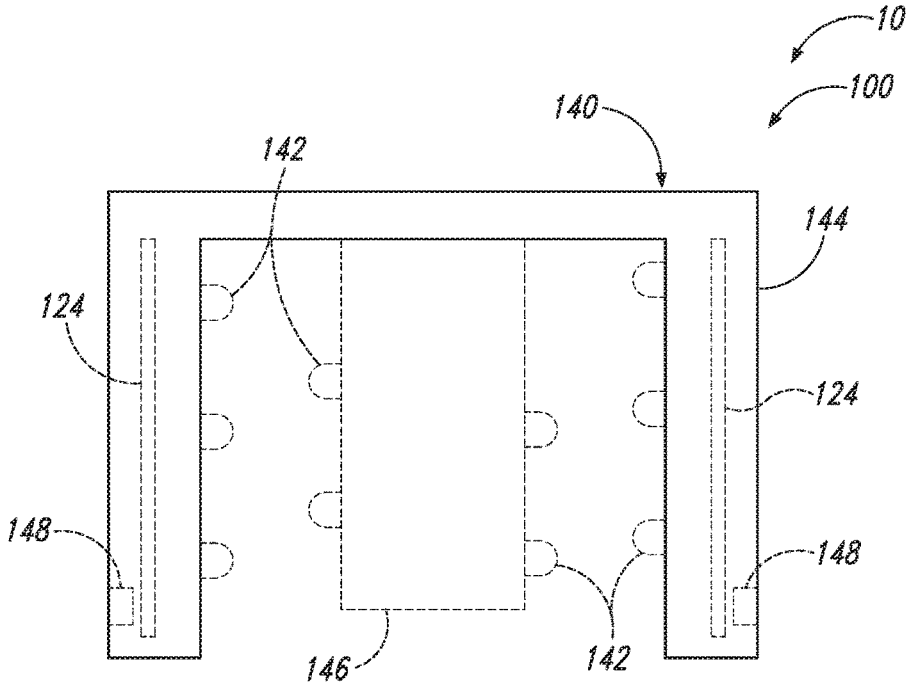
FIG. 3 is a schematic cross-sectional side elevation view representing examples of cap assembly closures according to the present disclosure.
Figure 4:
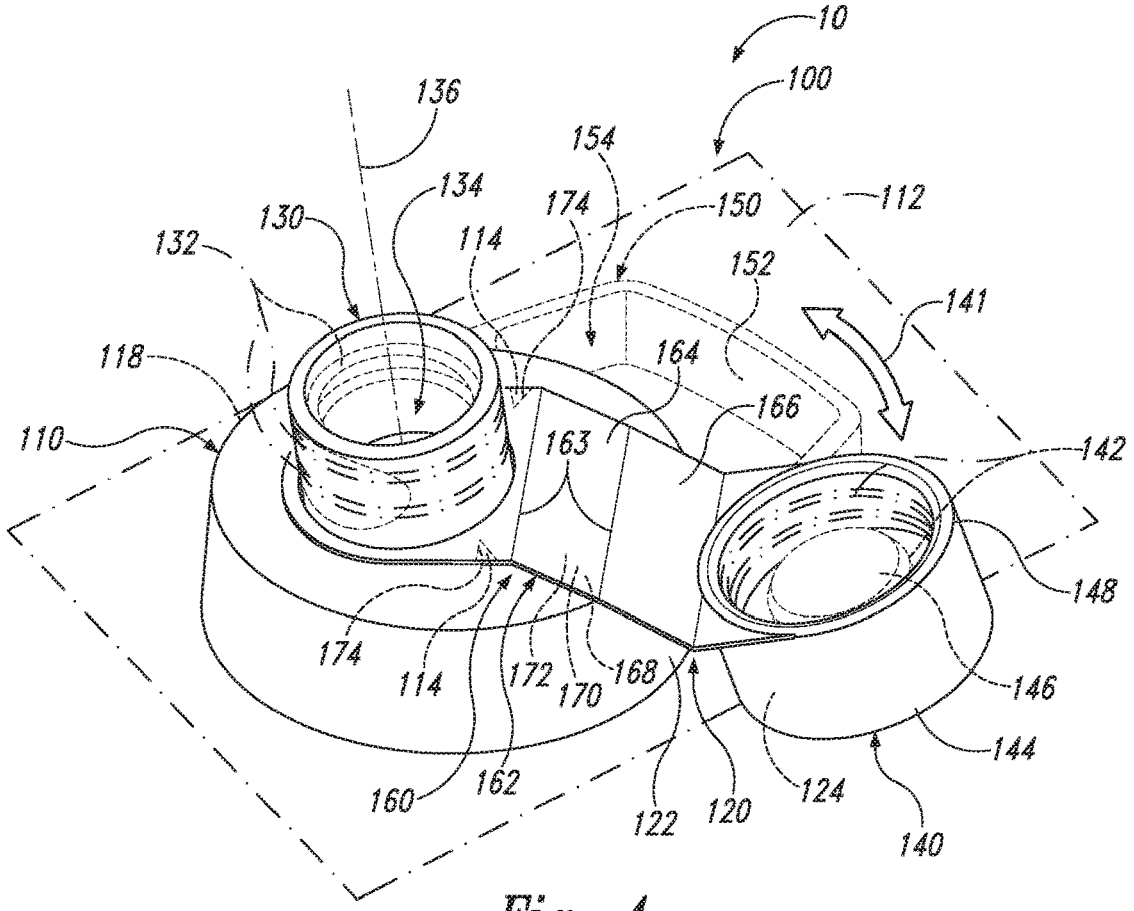
FIG. 4 is a side perspective view representing examples of cap assemblies according to the present disclosure with a closure in the stowed configuration.

Closure 140 may have any appropriate structure, and may be selectively coupled to drink spout 130 in any appropriate manner. FIG. 3 is a schematic cross-sectional view of examples of closure 140, and FIG. 4 is a less schematic illustration of an example of cap assembly 100. As illustrated in FIGS. 3-4, closure 140 may be generally cylindrical, and may include an outer cover 144 that at least substantially covers an exterior surface of drink spout 130 when the closure is in the closed configuration. As illustrated in dashed lines in FIGS. 3-4, closure 140 also may include an inner plug 146 that extends within drink spout 130 when the closure is in the closed configuration. In such an embodiment, drink spout 130 may include a spout coupling structure 132 (illustrated in FIG. 4), and closure 140 may include a closure coupling structure 142 configured to engage the spout coupling structure to seal the closure against the drink spout when the closure is in the closed configuration. Each of spout coupling structure 132 and closure coupling structure 142 may include and/or be a threaded coupling structure. As an example, closure coupling structure 142 may be positioned on an exterior surface of inner plug 146, and spout coupling structure 132 may be positioned on an interior surface of drink spout 130. As a more specific example, and as illustrated in dashed lines in FIGS. 3-4, inner plug 146 may include closure coupling structure 142 in the form of threads extending from an exterior surface of the inner plug, and drink spout 130 may include spout coupling structure 132 (illustrated in FIG. 4) in the form of threads extending from an interior surface of the drink spout. Additionally or alternatively, and as illustrated in dash-dot lines in FIGS. 3-4, outer cover 144 may include closure coupling structure 142 in the form of threads extending from an interior surface of the outer cover, and drink spout 130 may include spout coupling structure 132 (illustrated in FIG. 4) in the form of threads extending from an exterior surface of the drink spout. However, this is not required, and it is additionally within the scope of the present disclosure that spout coupling structure 132 and/or closure coupling structure 142 may include and/or be snap-fit arrangements, friction-fit arrangements, clasp arrangements, etc.

Closure 140 may be coupled to tether 160 in any appropriate manner. For example, closure 140 may include a tether coupling structure 148 configured to receive at least a portion of tether 160. As a more specific example, and as illustrated in FIGS. 3-4, tether coupling structure 148 may include and/or be a circumferential recess defined in closure 140 and/or in outer cover 144 thereof that receives at least a portion of tether 160, such that a portion of the tether extends around the closure. In such a configuration, closure 140 may be configured to rotate with respect to tether 160, such as to permit the closure to be screwed onto and off of drink spout 130 without the tether also rotating relative to and/or around the drink spout.

Closure magnetic material 124 may include and/or be any appropriate structure. For example, closure magnetic material 124 may extend sufficiently around a perimeter of closure 140 that the closure may be magnetically retained against base 110 regardless of the rotational orientation of the closure relative to the base. Stated differently, in an embodiment of cap assembly 100 that includes tether 160, closure magnetic material 124 may be positioned in closure 140 such that the closure may be magnetically retained against base 110 when the closure has any rotational orientation with respect to tether 160. As a more specific example, and as schematically illustrated in cross-section in FIG. 3, closure magnetic material 124 may be generally cylindrical, and may extend fully around a perimeter of closure 140, such that the closure magnetic material also extends fully around drink spout 130 when the closure is in the closed configuration. However, this is not required, and it is additionally within the scope of the present disclosure that closure magnetic material 124 includes a plurality of spaced-apart ferromagnetic materials and/or permanent magnets distributed around a perimeter of closure 140.

As further illustrated in FIG. 4, cap assembly 100 may be configured such that drink spout 130 is tilted, such as to facilitate drinking from the drink spout. Stated differently, and as illustrated in FIG. 4, base 110 may define a base plane 112 that is at least substantially parallel to neck 24 of liquid container 20 when the cap assembly is coupled to the liquid container, and drink spout 130 may be at least substantially symmetric about a drink spout axis 136 that passes through passage 134, such that the drink spout axis is not perpendicular to the base plane. As an example, and as illustrated in FIG. 4, drink spout axis 136 may be tilted generally away from handle 150. However, this is not required to all cap assemblies 100, and it is additionally within the scope of the present disclosure that drink spout axis 136 may be tilted in any appropriate manner, such as toward handle 150 and/or perpendicular to the base plane.

As further schematically illustrated in FIG. 4, tether 160 may include a visual indicator 170 configured to provide a visual indication that closure 140 is in the closed configuration. Hence, visual indicator 170 may provide a user with quick visual confirmation that cap assembly 100 is sealed from leaking or otherwise inadvertently dispensing the potable drink liquid through passage 134. For example, visual indicator 170 may include and/or be a concealed indicator 172 configured to be obstructed from view when closure 140 is in the closed configuration. As a more specific example, tether 160 may include an interior surface 168 that is substantially concealed (or at least substantially concealed) from view when closure 140 is in the closed configuration, and concealed indicator 172 may be positioned on the interior surface. Concealed indicator 172 may include and/or be any visual indication, such as a color and/or other indicia that differs from that of a remainder of tether 160 and/or from the corresponding exterior surface of the tether.

Figure 5:
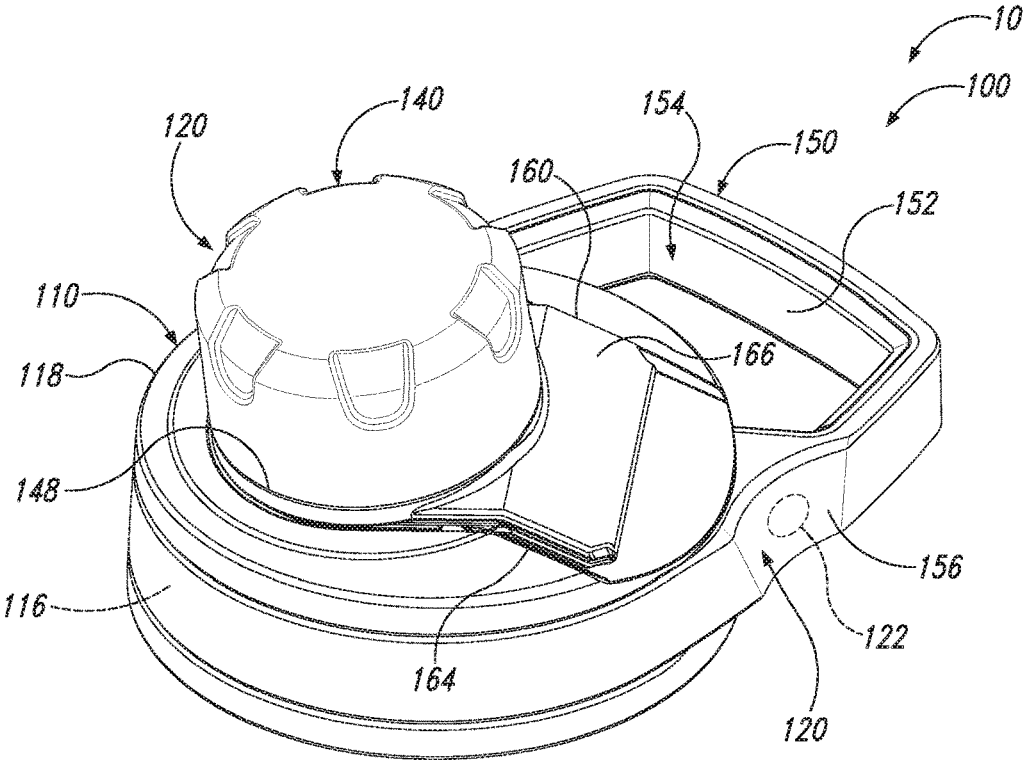
FIG. 5 is a side perspective view representing an example of a cap assembly according to the present disclosure with a closure in the closed configuration.
Figure 6:
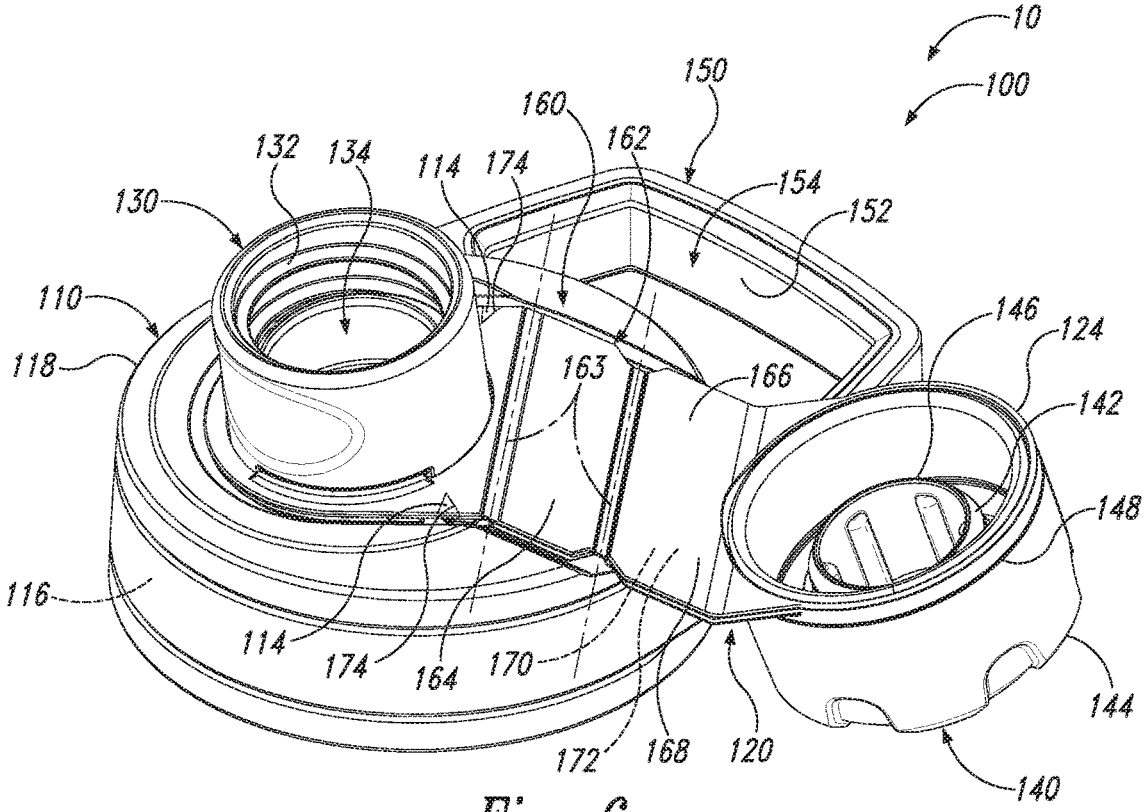
FIG. 6 is a side perspective view representing the cap assembly of FIG. 5 with the closure in the stowed configuration.
Figure 7:
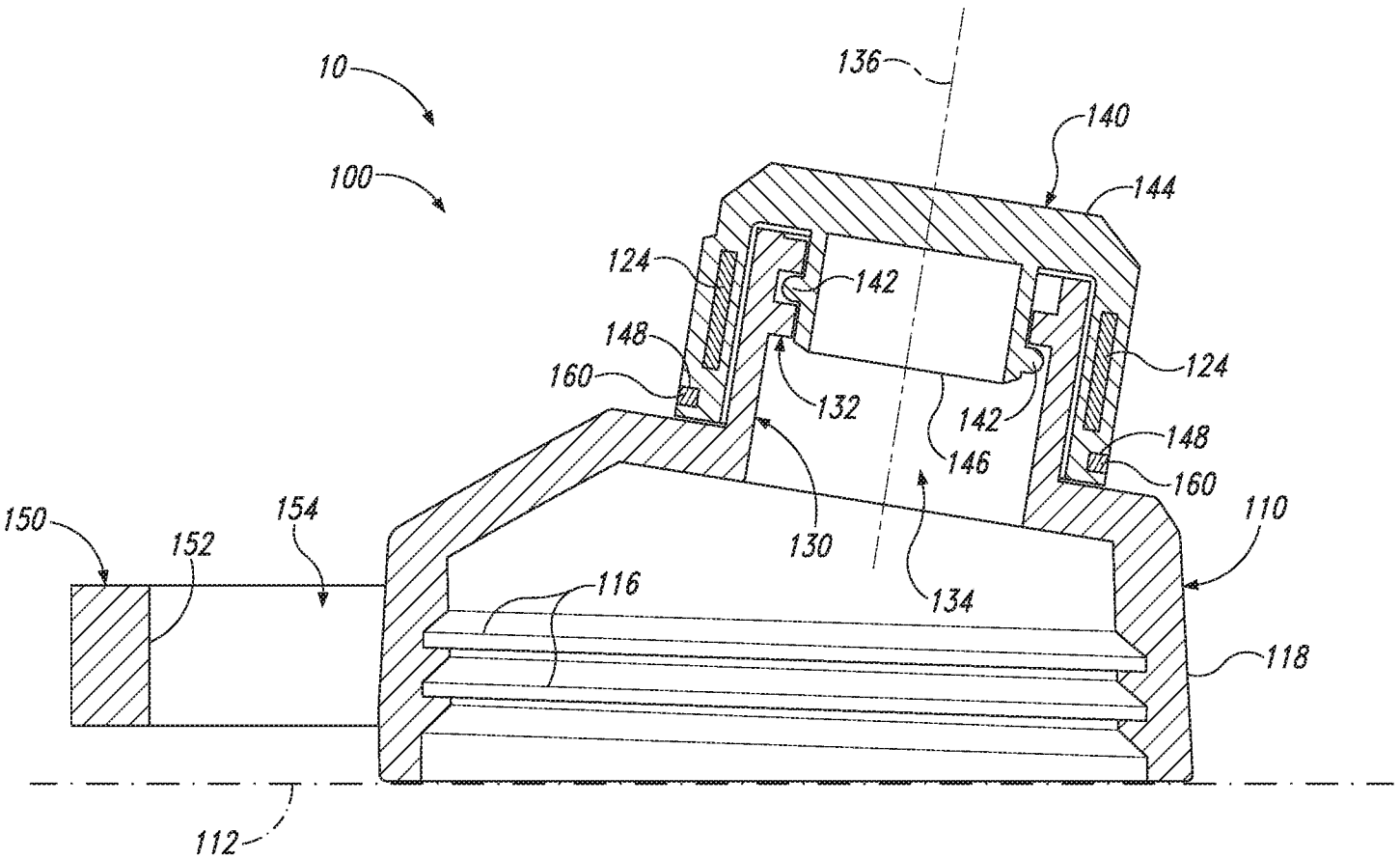
FIG. 7 is a cross-sectional side elevation view representing the cap assembly of FIG. 5 with the closure in the closed configuration.
Figure 8:
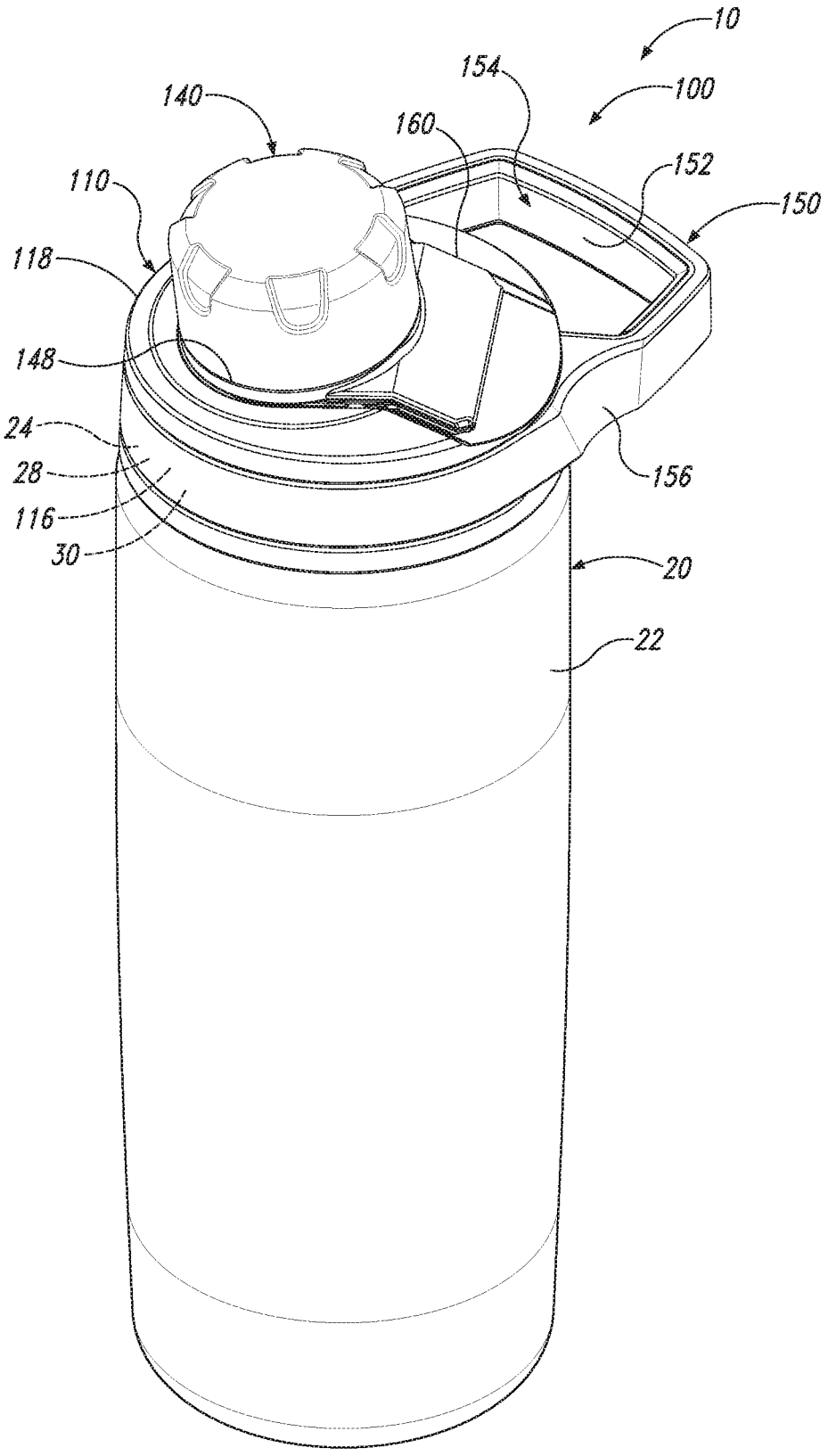
FIG. 8 is a side perspective view representing an example of a drink container including a cap assembly according to the present disclosure.

FIGS. 5-7 illustrate an example of cap assembly 100 according to the present disclosure, and FIG. 8 illustrates the example of the cap assembly coupled to a liquid container. As shown in FIG. 5, base 110 includes base body portion 118 and handle 150 extending from the base body portion, and includes a closure recess 156 defined in the handle. As illustrated in dashed lines in FIG. 5, base magnetic material 122 is positioned within closure recess 156. As perhaps best illustrated in FIG. 7, handle 150 is fixed to base body portion 118 and extends substantially parallel to base plane 112. As shown in FIG. 6, tether 160 includes a living hinge 162 with two hinge pivot axes 163 (indicated in FIG. 6). Tether 160 also includes a pair of retainer indentations 174 that receive a corresponding pair of tether retainers 114 to restrict rotation of the tether relative to drink spout 130. As perhaps best illustrated in FIG. 7, inner plug 146 of closure 140 includes closure coupling structure 142 in the form of threads extending from an exterior surface of the inner plug, and drink spout 130 includes spout coupling structure 132 in the form of threads extending from an interior surface of the drink spout. FIG. 7 additionally illustrates liquid container coupling structure 116 in the form of threads extending from an inner surface of base body portion 118 of base 110, and further illustrates drink spout 130 as being tilted such that drink spout axis 136 is oblique to base plane 112 and tilted away from handle 150.

Examples of cap assemblies according to the present disclosure are presented in the following enumerated paragraphs.

A1. A cap assembly for a drink container that includes a liquid container having a neck with an opening and having an internal compartment configured to hold a volume of potable drink liquid, the cap assembly comprising:

- a base configured to be selectively coupled to the neck of the liquid container;
- a drink spout extending from the base and defining a passage for dispensing the potable drink liquid;
- a closure configured to be selectively transitioned between a closed configuration and a stowed configuration via an open configuration; and
- a magnetic closure retention mechanism to magnetically retain the closure in the stowed configuration;

wherein in the closed configuration, the closure is operatively coupled to the drink spout and restricts flow of the potable drink liquid through the passage;

wherein in the open configuration, the drink spout is unobstructed by the closure and the closure is spaced apart from the drink spout to permit flow of the potable drink liquid through the passage; and wherein in the stowed configuration, the drink spout is unobstructed by the closure, the closure is spaced apart from the drink spout to permit flow of the potable drink liquid through the passage, and the closure is magnetically retained against the base by the magnetic closure retention mechanism.

A2. The cap assembly of paragraph A1, wherein the cap assembly further includes a tether that operatively couples the closure and the base.

A3. The cap assembly of paragraph A2, wherein the tether constrains the closure to travel along a predefined closure path as the closure transitions between the closed configuration, the open configuration, and the stowed configuration.

A4. The cap assembly of paragraph A3, wherein the tether restricts the closure path to extend at least substantially within a predefined closure plane.

A5. The cap assembly of any of paragraphs A2-A4, wherein a portion of the tether extends around the drink spout.

A6. The cap assembly of paragraph A5, wherein the portion of the tether that extends around the drink spout is restricted from rotating relative to the drink spout.

A7. The cap assembly of any of paragraphs A2-A6, wherein the base includes at least one tether retainer to restrict the tether from rotating relative to the drink spout.

A8. The cap assembly of paragraph A7, wherein the at least one tether retainer includes a recess that receives at least a portion of the tether.

A9. The cap assembly of any of paragraphs A7-A8, wherein the at least one tether retainer includes at least one projection that engages a corresponding retainer indentation defined by the tether.

A10. The cap assembly of any of paragraphs A2-A9, wherein the tether is at least substantially restricted from moving relative to the base when the closure is in at least one of the closed configuration and the stowed configuration.

All. The cap assembly of any of paragraphs A2-A10, wherein a portion of the tether extends around at least a portion of the closure.

A12. The cap assembly of any of paragraphs A2-A11, wherein the closure includes a tether coupling structure configured to engage at least a portion of the tether.

A13. The cap assembly of any of paragraphs A2-A12, wherein the closure is configured to rotate with respect to the tether.

A14. The cap assembly of any of paragraphs A2-A13, wherein the tether includes a hinge with at least one hinge pivot axis.

A15. The cap assembly of paragraph A14, wherein the hinge includes a plurality of hinge pivot axes.

A16. The cap assembly of any of paragraphs A14-A15, wherein the hinge is a living hinge.

A17. The cap assembly of any of paragraphs A14-A16, wherein the hinge includes a first hinge component proximal the drink spout relative to the closure when the closure is in the stowed configuration and a second hinge component proximal the closure relative to the drink spout when the closure is in the stowed configuration.

A18. The cap assembly of paragraph A17, wherein the first hinge component and the second hinge component extend adjacent to one another and at least substantially parallel to one another when the closure is in the stowed configuration.

A19. The cap assembly of any of paragraphs A17-A18, wherein the first hinge component and the second hinge component are at least one of coupled to and separated by a hinge pivot axis of the at least one hinge pivot axis.

A20. The cap assembly of any of paragraphs A17-A19, wherein each of the first hinge component and the second hinge component are at least substantially rigid.

A21. The cap assembly of any of paragraphs A17-A20, wherein the first hinge component extends adjacent to and at least substantially parallel to an exterior surface of the base when the closure is in the stowed configuration and when the closure is in the closed configuration.

A22. The cap assembly of any of paragraphs A17-A21, wherein the first hinge component and the second hinge component are at least substantially coplanar when the closure is in the stowed configuration.

A23. The cap assembly of any of paragraphs A2-A22, wherein the tether is formed of unitary construction.

A24. The cap assembly of any of paragraphs A2-A23, wherein the tether is formed of a single material.

A25. The cap assembly of any of paragraphs A2-A24, wherein the tether includes a visual indicator configured to provide a visual indication that the closure is in the closed configuration.

A26. The cap assembly of paragraph A25, wherein the visual indicator includes a concealed indicator configured to be obstructed from view when the closure is in the closed configuration.

A27. The cap assembly of paragraph A26, wherein the tether includes an interior surface that is at least substantially concealed from view when the closure is in the closed configuration, and wherein the concealed indicator is positioned on the interior surface of the tether.

A28. The cap assembly of any of paragraphs A26-A27, wherein the concealed indicator is a different color than a remainder of the tether.

A29. The cap assembly of any of paragraphs A1-A28, wherein the closure is generally cylindrical.

A30. The cap assembly of any of paragraphs A1-A29, wherein the drink spout includes a spout coupling structure, and wherein the closure includes a closure coupling structure configured to engage the spout coupling structure to seal the closure against the drink spout when the closure is in the closed configuration.

A31. The cap assembly of paragraph A30, wherein each of the spout coupling structure and the closure coupling structure includes a threaded coupling structure.

A32. The cap assembly of any of paragraphs A1-A31, wherein the closure includes an outer cover that at least substantially covers an exterior surface of the drink spout when the closure is in the closed configuration.

A33. The cap assembly of paragraph A32, when dependent from paragraph A30, wherein the outer cover includes the closure coupling structure, and wherein the exterior surface of the drink spout includes the spout coupling structure.

A34. The cap assembly of any of paragraphs A1-A33, wherein the closure includes an inner plug that extends within the drink spout when the closure is in the closed configuration.

A35. The cap assembly of paragraph A34, when dependent from paragraph A30, wherein the closure coupling structure is positioned on an exterior surface of the inner plug, and wherein the spout coupling structure is positioned on an interior surface of the drink spout.

A36. The cap assembly of any of paragraphs A1-A35, wherein the base includes a base body portion configured to be coupled to a liquid container and a handle configured to be gripped by a user, wherein the handle extends from the base body portion.

A37. The cap assembly of paragraph A36, wherein the handle is fixed to the base body portion.

A38. The cap assembly of any of paragraphs A36-A37, wherein the handle extends from the base body portion in a fixed orientation relative to the base body portion.

A39. The cap assembly of any of paragraphs A36-A38, wherein the handle and the base body portion are integrally formed.

A40. The cap assembly of any of paragraphs A36-A39, wherein the closure is at least partially retained against the handle when the closure is in the stowed configuration.

A41. The cap assembly of any of paragraphs A36-A40, wherein the handle forms at least a portion of a closed perimeter that defines a handle aperture sized to receive at least one of a user's fingers.

A42. The cap assembly of paragraph A41, wherein the closure is positioned external to the closed perimeter when the closure is in the stowed configuration.

A43. The cap assembly of any of paragraphs A41-A42, wherein the closure is restricted from obstructing the handle aperture when the closure is in the closed configuration and when the closure is in the stowed configuration.

A44. The cap assembly of any of paragraphs A41-A43, wherein the closure is positioned adjacent to the closed perimeter when the closure is in the stowed configuration.

A45. The cap assembly of any of paragraphs A1-A44, wherein the base includes at least one closure recess, and wherein the closure is received at least partially within the at least one closure recess when the closure is in the stowed configuration.

A46. The cap assembly of paragraph A45, when dependent from paragraph A36, wherein the closure recess is at least partially defined by the handle.

A47. The cap assembly of any of paragraphs A1-A46, wherein the magnetic closure retention mechanism includes a base magnetic material and a closure magnetic material, wherein the base includes the base magnetic material, and wherein the closure includes the closure magnetic material.

A48. The cap assembly of paragraph A47, wherein one of the base magnetic material and the closure magnetic material includes a permanent magnet, and wherein the other of the base magnetic material and the closure magnetic material includes at least one of a permanent magnet and a ferromagnetic material.

A49. The cap assembly of any of paragraphs A47-A48, when dependent from paragraph A13, wherein the closure magnetic material is positioned in the closure such that the closure may be magnetically retained against the base when the closure has any rotational orientation with respect to the tether.

A50. The cap assembly of any of paragraphs A47-A49, wherein the closure magnetic material extends sufficiently around a perimeter of the closure that the closure may be magnetically retained against the base regardless of the rotational orientation of the closure relative to the base.

A51. The cap assembly of any of paragraphs A47-A50, wherein the closure magnetic material extends fully around a/the perimeter of the closure.

A52. The cap assembly of any of paragraphs A47-A51, wherein the closure magnetic material is generally cylindrical.

A53. The cap assembly of any of paragraphs A47-A52, wherein the closure magnetic material extends fully around the drink spout when the closure is in the closed configuration.

A54. The cap assembly of any of paragraphs A47-A53, when dependent from paragraph A36, wherein at least one of the base body portion and the handle includes the base magnetic material.

A55. The cap assembly of any of paragraphs A47-A54, wherein the base magnetic material is positioned in a/the closure recess of the cap assembly.

A56. The cap assembly of any of paragraphs A1-A55, wherein the base defines a base plane that is at least substantially parallel to the neck of the liquid container when the cap assembly is coupled to the liquid container; wherein the drink spout is at least substantially symmetric about a drink spout axis, and wherein the drink spout axis is not perpendicular to the base plane.

A57. The cap assembly of paragraph A56, wherein the drink spout axis is tilted generally away from a/the handle of the cap assembly.

A58. The cap assembly of any of paragraphs A1-57 in combination with the drink container.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function.

It is also within the scope of the present disclosure that elements, components, and/or other recited subject matter that is recited as being adapted to perform a particular function may additionally or alternatively be described as being configured to perform that function, and vice versa.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

INDUSTRIAL APPLICABILITY

The drink containers disclosed herein are applicable to the beverage container industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A cap assembly for a drink container that includes a liquid container having a neck with an opening and having an internal compartment configured to hold a volume of potable drink liquid, the cap assembly comprising:

a base configured to be selectively coupled to the neck of the liquid container;

a drink spout extending from the base and defining a passage for dispensing the potable drink liquid;

a closure configured to be selectively transitioned between a closed configuration and a stowed configuration via an open configuration;

a magnetic closure retention mechanism to magnetically retain the closure in the stowed configuration; and a tether that operatively couples the closure and the base;

wherein in the closed configuration, the closure is operatively coupled to the drink spout and restricts flow of the potable drink liquid through the passage;

wherein in the open configuration, the drink spout is unobstructed by the closure and the closure is spaced apart from the drink spout to permit flow of the potable drink liquid through the passage;

wherein in the stowed configuration, the drink spout is unobstructed by the closure, the closure is spaced apart from the drink spout to permit flow of the potable drink liquid through the passage, and the closure is magnetically retained against the base by the magnetic closure retention mechanism;

wherein the tether constrains the closure to travel along a predefined closure path as the closure transitions between the closed configuration, the open configuration, and the stowed configuration;

wherein the closure path extends at least substantially within a predefined closure plane; and wherein the closure is configured to rotate with respect to the tether.

2. The cap assembly of claim 1, wherein the base includes a base body portion configured to be coupled to a liquid container and a handle configured to be gripped by a user, wherein the handle extends from the base body portion.

3. The cap assembly of claim 2, wherein the magnetic closure retention mechanism includes a base magnetic material and a closure magnetic material, wherein at least one of the base body portion and the handle includes the base magnetic material, and wherein the closure includes the closure magnetic material.

4. The cap assembly of claim 2, wherein the handle extends from the base body portion in a fixed orientation relative to the base body portion and is restricted from moving relative to the base body portion.

5. The cap assembly of claim 2, wherein the handle and the base body portion are monolithic.

6. The cap assembly of claim 2, wherein the closure is at least partially retained against the handle when the closure is in the stowed configuration.

7. The cap assembly of claim 2, wherein the base includes at least one closure recess, wherein the closure is received at least partially within the at least one closure recess when the closure is in the stowed configuration, and wherein the closure recess is at least partially defined by the handle.

8. The cap assembly of claim 2, wherein the handle forms at least a portion of a closed perimeter that defines a handle aperture sized to receive at least one of a user's fingers, and wherein the closure is positioned external to the closed perimeter when the closure is in the stowed configuration.

9. The cap assembly of claim 1, wherein the tether is restricted from moving relative to the base when the closure is in each of the closed configuration and the stowed configuration.

10. The cap assembly of claim 1, wherein a portion of the tether extends around the drink spout, and wherein the portion of the tether that extends around the drink spout is restricted from rotating with respect to the drink spout.

11. The cap assembly of claim 1, wherein the magnetic closure retention mechanism includes a base magnetic material and a closure magnetic material, wherein the closure includes the closure magnetic material, and wherein the closure magnetic material is positioned in the closure such that the closure may be magnetically retained against the base when the closure has any rotational orientation with respect to the tether.

12. The cap assembly of claim 1, wherein the tether includes a hinge with at least one hinge pivot axis, wherein the hinge includes a first hinge component and a second hinge component, wherein the first hinge component and the second hinge component are separated by a hinge pivot axis of the at least one hinge pivot axis, wherein the first hinge component is proximal the drink spout relative to the closure when the closure is in the stowed configuration, and wherein the second hinge component is proximal the closure relative to the drink spout when the closure is in the stowed configuration.

13. The cap assembly of claim 12, wherein the first hinge component and the second hinge component extend adjacent to one another and at least substantially parallel to one another when the closure is in the stowed configuration.

14. The cap assembly of claim 12, wherein each of the first hinge component and the second hinge component are at least substantially rigid.

15. The cap assembly of claim 12, wherein the first hinge component and the second hinge component are at least substantially coplanar when the closure is in the stowed configuration.

16. The cap assembly of claim 12, wherein the tether includes a visual indicator configured to provide a visual indication that the closure is in the closed configuration, and wherein the visual indicator includes a concealed indicator configured to be obstructed from view when the closure is in the closed configuration.

17. The cap assembly of claim 1, wherein the closure includes an inner plug that extends within the drink spout when the closure is in the closed configuration, wherein the drink spout includes a spout coupling structure, wherein the closure includes a closure coupling structure configured to engage the spout coupling structure to seal the closure against the drink spout when the closure is in the closed configuration, wherein the closure coupling structure is positioned on an exterior surface of the inner plug, and wherein the spout coupling structure is positioned on an interior surface of the drink spout.

18. The cap assembly of claim 1, in combination with a drink container that includes a liquid container having a neck with an opening and having an internal compartment configured to hold a volume of potable drink liquid.

19. A cap assembly for a drink container that includes a liquid container having a neck with an opening and having an internal compartment configured to hold a volume of potable drink liquid, the cap assembly comprising:

a base configured to be selectively coupled to the neck of the liquid container;

a drink spout extending from the base and defining a passage for dispensing the potable drink liquid;

a closure configured to be selectively transitioned between a closed configuration and a stowed configuration via an open configuration;

a magnetic closure retention mechanism to magnetically retain the closure in the stowed configuration; and a tether that operatively couples the closure and the base;

wherein in the closed configuration, the closure is operatively coupled to the drink spout and restricts flow of the potable drink liquid through the passage;

wherein in the open configuration, the drink spout is unobstructed by the closure and the closure is spaced apart from the drink spout to permit flow of the potable drink liquid through the passage;

wherein in the stowed configuration, the drink spout is unobstructed by the closure, the closure is spaced apart from the drink spout to permit flow of the potable drink liquid through the passage, and the closure is magnetically retained against the base by the magnetic closure retention mechanism;

wherein the tether is restricted from moving relative to the base when the closure is in each of the closed configuration and the stowed configuration; and wherein the closure is configured to rotate with respect to the tether.

20. The cap assembly of claim 19, wherein the base includes a base body portion configured to be coupled to a liquid container and a handle configured to be gripped by a user, wherein the handle extends from the base body portion, and wherein the handle extends from the base body portion in a fixed orientation relative to the base body portion and is restricted from moving relative to the base body portion.

21. The cap assembly of claim 19, wherein the base includes a base body portion configured to be coupled to a liquid container and a handle configured to be gripped by a user, wherein the handle extends from the base body portion, and wherein the closure is at least partially retained against the handle when the closure is in the stowed configuration.

22. The cap assembly of claim 19, wherein the base includes a base body portion configured to be coupled to a liquid container and a handle configured to be gripped by a user, wherein the handle extends from the base body portion, wherein the base includes at least one closure recess, wherein the closure is received at least partially within the at least one closure recess when the closure is in the stowed configuration, and wherein the closure recess is at least partially defined by the handle.

23. The cap assembly of claim 19, wherein the closure includes an inner plug that extends within the drink spout when the closure is in the closed configuration, wherein the drink spout includes a spout coupling structure, wherein the closure includes a closure coupling structure configured to engage the spout coupling structure to seal the closure against the drink spout when the closure is in the closed configuration, wherein the closure coupling structure is positioned on an exterior surface of the inner plug, and wherein the spout coupling structure is positioned on an interior surface of the drink spout.

24. The cap assembly of claim 19, in combination with a drink container that includes a liquid container having a neck with an opening and having an internal compartment configured to hold a volume of potable drink liquid.

* * * * *